US005864228A

United States Patent [19]

Brown et al.

[11] Patent Number: 5,864,228

[45] Date of Patent: Jan. 26, 1999

[54] CURRENT MIRROR CURRENT SOURCE WITH CURRENT SHUNTING CIRCUIT

[75] Inventors: Gary Brown, Fremont; John Andrew Campbell, Davis; Jitendra Mohan, Palo Alto, all of Calif.

[73] Assignee: National Semiconductor Corporation, Santa Clara, Calif.

[21] Appl. No.: 831,368

[22] Filed: Apr. 1, 1997

[51] Int. Cl.[6] ..... G05F 3/16

[52] U.S. Cl. ..... 323/315

[58] Field of Search ..... 323/315

[56] References Cited

U.S. PATENT DOCUMENTS

| | | | |
|---|---|---|---|
| 4,325,017 | 4/1982 | Schade | 323/315 |
| 4,408,190 | 10/1983 | Nagano | 323/315 |
| 4,647,870 | 3/1987 | Ishii et al. | 323/315 |
| 4,910,480 | 3/1990 | Crosby | 323/315 |
| 5,394,080 | 2/1995 | Rijns | 323/315 |

*Primary Examiner*—Jeffrey Sterrett
*Attorney, Agent, or Firm*—Limbach & Limbach L.L.P.

[57] ABSTRACT

A stacked current mirror circuit includes four N-channel MOS transistors. One transistor serves as an input device for conducting via its drain, a majority of the reference current. Another transistor is connected as a mirroring device, with its drain coupled to a voltage source, its gate coupled to the gate of the input device, and its source coupled to the source of the input device at a first common node. These two transistors couple to form a first current mirror circuit which couples to the input of a second current mirror comprising the third and fourth transistors. The drain and gate of the third transistor couple to the first common node and the gate of the fourth transistor. The sources of both the third and fourth transistors couple to a second common node (e.g., ground), and the drain of the fourth transistor provides the output. As a result, current is mirrored from the input device transistor to the mirroring device transistor, and then forced through the third transistor. The current is then mirrored from the third transistor to the fourth transistor which forces the current to the output line.

5 Claims, 2 Drawing Sheets

CURRENT MIRROR CURRENT SOURCE WITH CURRENT SHUNTING CIRCUIT

BACKGROUND OF THE INVENTION

1. Field of the Invention

The invention relates to transistor current sources, and in particular, to current mirror circuits.

2. Description of the Related Art

Current mirror circuits of the type to which the present invention relates are widely used as basic building blocks in the design of analog integrated circuits. They may be employed as biasing elements, active loads (e.g., such as in amplifier stages) or as all-purpose current sources (e.g., such as bit current cells in analog-to-digital converters). Some desirable current mirror attributes include accuracy, low voltage drop, and high speed (bandwidth). Basic topologies for conventional current mirror circuits that have proven useful are the simple current mirror, the Wilson mirror, and the cascode mirror.

A current mirror is a current input/output device which, ideally, has zero input impedance and infinite output impedance, so that current output remains a fixed function of current input, regardless of variations in output load, variations in output voltage, or fluctuations in the applied power source. However, the conventional current mirror circuit experiences problems when operating at high current.

In high current applications, the output transistor must be relatively large to facilitate the high current required. Therefore, in most realizable integrated processes, the parasitic capacitance, formed by the internal capacitance between the gate of this output transistor and ground, will be relatively large. As a result, when the current mirror circuit drives this largely capacitive low impedance load an undesirable low frequency pole is created. This pole is formed with the capacitance and the impedance of the current mirror circuit. The problem arises due to the inability to do more than only slightly adjust the pole without affecting the gain ratio desired to amplify the input current. Though particular embodiments discussed herein are implemented utilizing N-channel MOS circuit technology, it should be understood that the same circuits may also be implemented utilizing P-channel MOS or bipolar circuit technologies.

FIG. 1 illustrates a prior art simple current mirror 10 implemented using N-channel MOS transistors. Ideally, the function of current mirror 10 is to match channel current $I_{OUT}$ through transistor T2 to channel current $I_{IN}$ through transistor T1, such that current $I_{OUT}$ "mirrors" current $I_{IN}$. The gate of transistor T2 connects to the gate of transistor T1, and the sources of transistors T1 and T2 connect to a common voltage source (e.g., ground), so that the gate-to-source voltages of transistors T1 and T2 are equal ($V_{GS1}=V_{GS2}$). Therefore, when transistor T2 operates in saturation, the channel current $I_{OUT}$ through transistor T2 is equal to some pre-established fixed multiple of channel current $I_{IN}$ through transistor T1. This is true for devices operating both at or above threshold ($V_{GS1} \geqq = V_T$) and in the subthreshold region ($V_{GS} < V_T$).

The simple current mirror circuit experiences problems when operating at high currents, thereby requiring T2 to be relatively large. The result is the creation of the low frequency pole formed by the impedance of the circuit and the capacitance of transistor T2 between its gate and ground.

Forms of cascoding or stacking of current mirror circuits have been utilized to reduce the effect of the pole while simultaneously achieving a desired gain. FIG. 2 illustrates a prior art N channel current mirror, commonly known as the "Wilson current mirror." The sources of transistors T1 and T2 are connected together to ground, and the gates of transistors T1 and T2 are connected together. Therefore, the source-gate voltage of transistors T1 and T2 are equal ($V_{GS1}=V_{GS2}$). The gate and drain of transistor T2 are connected together, forcing transistor T2 into saturation. The input current $I_{IN}$ which is to be mirrored is connected to the drain of transistor T1 and an output current $I_{OUT}$ is seen at the drain of a third transistor T3. Transistor T3 isolates the drain of transistor T2 from the voltage applied to the drain of transistor T3, thereby preventing any variation in T3 drain voltage from affecting current $I_{IN}$.

An undesirable side effect of cascoding, however, is that output voltage swing (range of output voltage for which the output resistance remains high) becomes limited due to the need to maintain additional series-connected devices in their desired (e.g., saturated for MOS devices) operating regions. This problem of loss of voltage range is further compounded by the increasing desire to provide integrated circuits capable of operating at lower $V_{DD}$ voltages of 3.0 V rather than 5.0 V. This low voltage in a conventional current mirror circuit is in many circumstances insufficient to allow design and/or proper operation of circuitry serving as current sources. Additionally, the cascoding configuration fails to eliminate the effect of the low frequency pole created at the input node when the circuit operates at high current.

A conventional cascode current mirror 30 is shown in FIG. 3. The cascode mirror 30 is characterized by the addition of a second mirrored pair of transistors T3 and T4, respectively connected between the first pair of transistors T1 and T2 and the input/output terminals, as shown. Transistor T3 has its drain connected to input terminal+$V_{IN}$ and its source connected to the drain of transistor T1. Transistor T4 has its drain connected to output terminal+$V_{OUT}$, its source connected to the drain of transistor T2, and its gate connected to the gate of transistor T3. As a result, current $I_{IN}$ flowing through transistors T1 and T3, and current $I_{OUT}$ flowing through transistors T2 and T4 are related in accordance with a fixed aspect ratio of transistors T1 and T2, as for the simple mirror circuit 10 of FIG. 1. Cascode current mirror 30 is, therefore in effect, a cascaded series of two current mirrors 10 of FIG. 1.

This cascode circuit 30 has the same problems as the "Wilson current mirror" circuit in that voltage range loss occurs because of the series-connected transistor configuration and the low frequency pole remains in high current operation.

As mentioned above, there is a strong demand for current mirror circuits designed to operate at high current and with low voltage requirements. However, when the existing circuits operate at high current and drive large transistors having extremely large capacitances between their gates and ground, a low frequency pole results. In these existing current mirror circuits, there is no way to do more than only slightly alter the pole without affecting the gain. Thus, a need exists for a circuit comprising small transistors that reduces the effect of this low frequency pole without lowering the gain, operates at a low voltage, and drives very large signals at the output while maintaining wide bandwidth and high current.

SUMMARY OF THE INVENTION

The present invention provides a current source having a low input impedance and wide bandwidth, without the voltage range limitations of the aforementioned circuits.

This current source is achieved by having transistor devices configured in a current mirror fashion.

A stacked current mirror circuit in accordance with a preferred embodiment of the present invention includes four MOS transistors. The drain of the first transistor couples to a reference node for conducting a reference current, while its source couples to a first common node. The source of the second transistor also couples to the first common node while its drain couples to a voltage source and its gate couples to the gate of the first transistor whose gate and drain are joined. The drain of the third transistor couples to the first common node, while its source couples to a second common node (e.g., circuit ground). The source of the fourth transistor couples to the second common node, while its gate couples to the gate of the third transistor whose gate and drain are joined.

The first and second transistors connect in mirroring fashion to form the first transistor pair, and the third and fourth transistors connect in mirroring fashion to form the second transistor pair. The first transistor pair couples to the input of the second transistor pair such that the output of the first transistor pair is the input of the second transistor pair. This configuration lowers the impedance seen by a load at the output of the second transistor pair. This in turn reduces the effect of the low frequency pole at the input of the second transistor pair created when the circuit operates at high current.

A stacked current mirror circuit in accordance with an alternative preferred embodiment of the present invention includes the stacked current mirror configuration described above with the addition of a fifth MOS transistor. The drain of this transistor couples to the reference node, the gate couples to the first common node and the source couples to the second common node. The addition of this feedback transistor further lowers the input impedance of the stacked current mirror circuit.

Lowering the impedance seen by the load of the second transistor pair reduces the effect of the low frequency pole which in turn, increases the bandwidth of the current source. As a result, the stacked current mirror circuit functions as a current amplifier to drive a very low impedance load at high current.

These and other features and advantages of the present invention will be understood upon consideration of the following detailed description of the invention and the accompanying drawings.

DETAILED DESCRIPTION OF THE INVENTION

Figure 4:
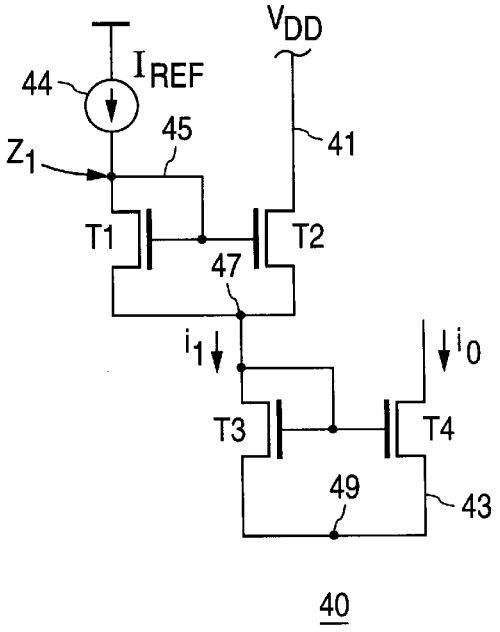
FIG. 4 is a schematic diagram of a first preferred embodiment of a current mirror circuit in accordance with the present invention.

In accordance with an illustrative embodiment of the invention, a stacked current mirror circuit 40 is shown in FIG. 4. Circuit 40 displays a stacked current mirror design which simultaneously achieves wide bandwidth and low voltage operation. Though N-channel MOS components are depicted, it will be appreciated that the same principles can be implemented using P-channel MOS or bipolar components.

A transistor is a three terminal semiconductor device in which a voltage applied between a first terminal and a second or third terminal can control current flow in a current path or channel between the second and third terminals. In a MOS field effect transistor, the first or control terminal is referred to as the "gate" and the second and third terminals are referred to as the "source" and "drain". In bipolar transistors, the same terminals are respectively referred to as "base", "emitter" and "collector". The terms "gate", "source" and "drain" as used herein are, thus, intended to encompass the corresponding terms "base", "emitter" and "collector".

A first pair of N-channel MOS transistors T1 and T2 couple together in a mirror configuration to form the first current mirror circuit 41. The drain of transistor T1 couples to a reference node 45 and to the gates of transistors T1 and T2 which couple together. The sources of transistors T1 and T2 couple to a first common node 47. The drain of transistor T2 couples to a voltage source.

A second pair of N-channel MOS transistors T3 and T4 couple together in a mirror configuration to form the second current mirror circuit 43. The drain of transistor T3 couples to the first common node 47 and to the gates of transistors T3 and T4 which couple together. The sources of T3 and T4 couple to a second common node 49. Thus, the configuration of the stacked current mirror circuit 40 depicted in FIG. 4 includes the first current mirror circuit 41 coupled to the input side of the second current mirror circuit 43 at the first common node 47, in cascoded fashion, to drive the second circuit 43.

In general, the stacked current mirror circuit 40 functions in a typical manner. Current reference 44 provides current $I_{REF}$ which is mirrored from transistor T1 to transistor T2, and then forced through cascoded transistor T3. The current is then mirrored from transistor T3 to transistor T4 which forces the current to output line 48. Alternatively, current reference 44 may be replaced by an input current provided by another source.

In a preferred embodiment, the current signal $i_1$ drives a large low impedance load in the second current mirror circuit 43. This signal $i_1$ can be injected into the stacked current mirror circuit 40 at two locations. In one instance, the signal $i_1$ is injected at the reference node 45. When the signal, represented as reference current $I_{REF}$ in FIG. 4, is injected at this node the first current mirror circuit 41 provides preamplification. This added gain provided by this design is desirable if the circuit is driving a very large signal at the output. In this situation, the current would take the path of the reference current $I_{REF}$, described above. The reference node 45 conducts the reference current $I_{REF}$ of the current source through the first current mirror circuit 41 to the first common node where it is input into the second current mirror circuit 43. At the input to this circuit 43, the current $i_1$ is:

$$i_1=((W/L)_{T2}/(W/L)_{T1})*I_{REF} \quad \text{equation (1)}$$

where T2 is the ratio of channel width to channel length of transistor T2, where T1 is the ratio of channel width to channel length of transistor T1, and where the +1 term is an error component, but where this small amount of current is virtually negligent.

In a second instance, a small signal current riding on top of a small dc bias current runs through the first current mirror circuit 41. The function of this current is to just keep the first circuit 41 operable so the bandwidth of the current source is doubled, and the impedance seen at the first common node 47 is reduced. Then, a larger signal from an external source is input at the first common node 47 into the second current mirror circuit to drive the large capacitance load.

With this circuit topology, the signal has a DC and an AC component. The DC component is as follows:

$$i_1=((W/L)_{T2}/(W/L)_{T1})+1)*I_{REF} \quad \text{equation (1)}$$

above $$i_{OUT}=((W/L)_{T4}/(W/L)_{T3})*_1=(W/L)_{T4}/(W/L)_{T3})*(W/L)_{T2}/(W/L)_{T1}+1)*I_{REF} \quad \text{equation (2)}$$

if T2>>T1, then $$i_{OUT}=((W/L)_{T4}/(W/L)_{T3})*(W/L)_{T2}/(W/L)_{T1})*I_{REF} \quad \text{equation (3)}$$

$$\text{Gain}=i_{OUT}/I_{REF}=((W/L)_{T4}/(W/L)_{T3})*(W/L)_{T2}/(W/L)_{T1}) \quad \text{equation (4)}$$

Because the circuit drives large output currents into a load, transistor T4 is large. As a result, the internal capacitance between the gate of transistor T4 and ground is large. This large capacitance produces an undesirable long time constant (T=R*CGS, where T is the time constant, R is the resistance, and CGS is the internal capacitance). The AC component yields the following dominant pole:

$$P_D=1/((CGS_{T4}+CGS_{T3})(1/g_{mT3}\|1/g_{mT2})) \quad \text{equation (5)}$$

where $CGS_{T4}$ is the gate to source capacitance of transistor T4, $CGS_{T3}$ is the gate to source capacitance of transistor T3, $g_{mT3}$ is the transconductance of transistor T3, $g_{mT2}$ is the transconductance of transistor T2, and ‖ means in parallel with.

$$CGS=CGS_{T3}+CGS_{T4} \quad \text{equation (6)}$$

if T3=T2 then $g_{mT3}=g_{mT2}=G_M$, then where $G_M$ is the gain $$P_D=2G_M/CGS \quad \text{equation (7)}$$

Figure 1:
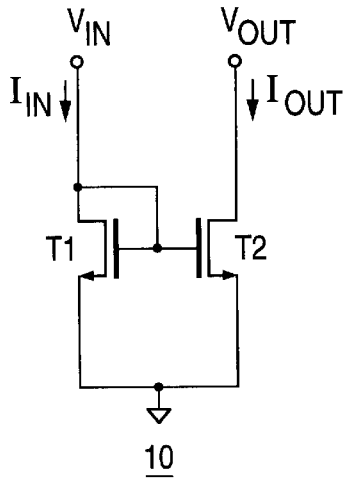
FIG. 1 (PRIOR ART)
FIG. 1 is a schematic diagram of a conventional simple current mirror circuit.
Figure 2:
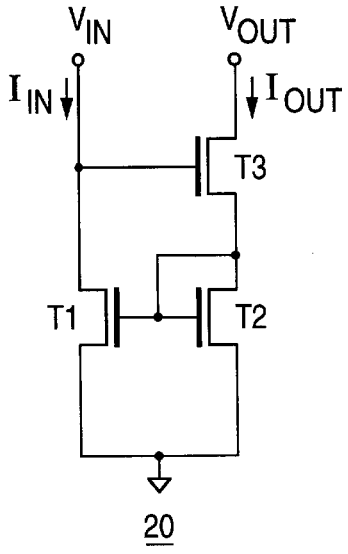
FIG. 2 (PRIOR ART)
FIG. 2 is a schematic diagram of a conventional Wilson current mirror circuit.

The use of the first current mirror circuit 41 as an input to the second current mirror circuit 43 lowers by ½ $g_m$, the impedance seen by the relatively large load capacitance between the gate of transistor T4 and ground, which in turn, lowers the effect of the parasitic time constant or pole. This configuration overcomes the existing problem of the prior art current mirror circuits, such as the "Wilson current mirror" circuit shown in FIG. 2, of the inability to change the pole without effecting the gain ratio (i.e., $(W/L)_{T4}/(W/L)_{T3}$). The first current mirror circuit has an effective input impedance of:

$$Z_1=(1/g_{mT1})+(1/S_{mT3}) \quad \text{equation (8)}$$

By stacking the first current mirror circuit 41 on top of the second current mirror circuit 43, the second current mirror circuit 43 has a very low impedance looking into it, which effectively lowers the impedance seen by the load capacitance in the second current mirror circuit 43 as well as doubles the bandwidth of the second current mirror circuit 43. By lowering the impedance seen by the load, the circuit effectively cancels the effect of the pole created by the capacitance of transistor T4.

An additional benefit of this stacked current mirror circuit 40 is that by selecting specific sizes for the transistor components, the gain can easily be determined. If the sizes of transistors T2 and T3 are selected to be equivalent, then the dc gain is simply the ratio of $(W/L)_{T4}/(W/L)_{T1}$). In this configuration the circuit functions as a Darlington pair. Applying equation (4), if T2=T3, then $$i_{OUT}=(W/L)_{T4}/(W/L)_{T1})*I_{REF} \text{ and } A_I=(W/L)_{T4}/(W/L)_{T1}) \quad \text{equation (9)}$$

The benefit of this Darlington circuit configuration is that the circuit behaves like a single transistor with a higher gain. This circuit topography is particularly useful where high currents are involved (e.g., power amplifier output stages).

A further advantage of the stacked current mirror circuit invention results from the capability of injecting a signal current into the stacked current mirror circuit 40 in two locations. If all of the signal current is injected into the circuit 40 at the reference node 45, then the current flows through both the first current mirror circuit 41 and the second current mirror circuit 43. This current flow doubles the voltage at the reference node 45 because of the $V_{GS}$ voltage drop across transistors T1 and T3. On the other hand, if the signal current is injected into the current mirror circuit 40 at the first common node 47, and a very small reference current $I_{REF}$ is used to keep the first current mirror circuit 41 operative, the signal only raises the voltage at the first common node 47 based upon the amount of current flowing through the second current mirror circuit 43. Thus, since voltage is required only at the first common node, the minimum saturation voltage required for operation is $V_{SATMIN}=V_T+V_D$, where $V_T$ is the threshold voltage and $V_D$ is the overdrive voltage above the threshold voltage.

Figure 3:
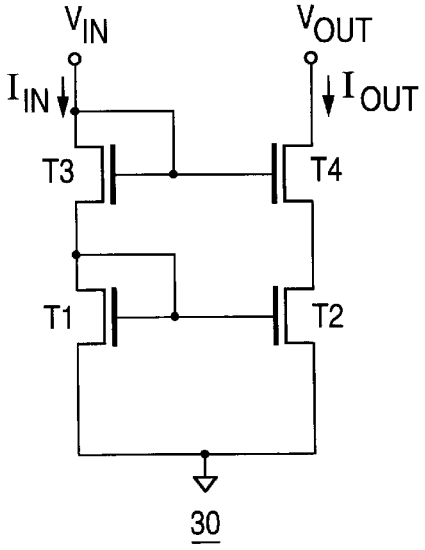
FIG. 3 (PRIOR ART)
FIG. 3 is schematic diagram of a conventional cascode current mirror circuit.

In contrast to this low voltage requirement, some other current mirror circuits require higher voltages. For example, a greater minimum saturation voltage is required for operation of the Wilson current mirror 20 of FIG. 2 and the cascode current mirror 30 of FIG. 3 because current flows through both of the series-connected transistors. With these circuit topologies, the amount of current input generates a $V_{GS}$ term at transistor T3, which increases the voltage at T1 (or T2). Thus, to operate these current mirror circuits requires a minimum saturation voltage of $V_{SATMIN}=2*(V_T+V_D)$. This is double the voltage required to operate the stacked current mirror circuit 40. Thus, the stacked current mirror circuit 40 is a more efficient circuit.

The stacked current mirror circuit 40 still has some disadvantages depending on the frequency of the input signal. As mentioned above, a signal can be input either at the reference node 45 or at the first common node 47 to drive a very large capacitive load at the output. If a signal having a high frequency is input at the first common node 47, then this signal will see the capacitance directly. This creates the undesirable low frequency pole. However, if the high frequency signal is injected at the reference node, the first current mirror circuit buffers the very large capacitance the signal would see if the signal had been injected directly into the first common node. Thus, it is more efficient to inject the high frequency signals at the reference node.

Figure 5:
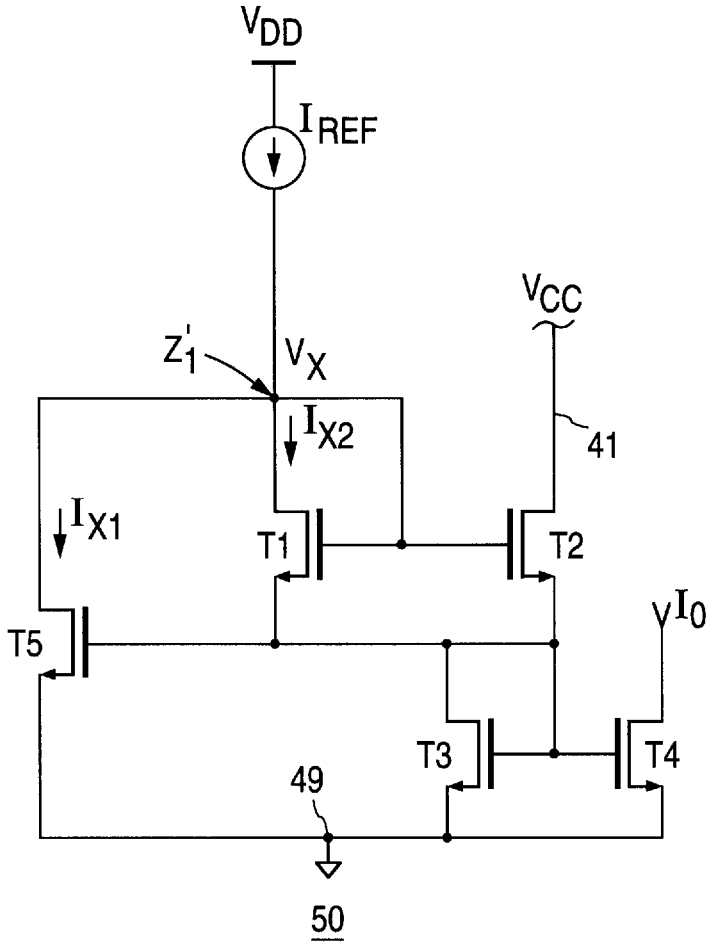
FIG. 5 is a schematic diagram of a second preferred embodiment of a current mirror circuit in accordance with the present invention.

There is an alternate way to reduce the effect of the low frequency pole besides injecting the signal at the reference node 45. FIG. 5 illustrates another embodiment of the invention where a fifth transistor T5 is added to the stacked current mirror circuit 40. The drain of this transistor couples to the reference node 45, the gate couples to the first common node 47 and the source couples to the second common node 49. Transistor T5 is added for feedback to lower the impedance seen at the reference node 45. With this topology, the pole associated at the first common node 47 can be controlled with the size of transistor T5, which results in an even faster current source. This transistor feedback mechanism lowers the effect of the pole, and reduces the voltage Vx at the reference node 45. This results in the first current mirror circuit having the following input impedance $Z_1'$:

$$Z_1'=Vx/Ix \quad \text{equation (10)}$$

$$Ix=Ix_1+Ix_2 \quad \text{equation (11)}$$

$$Ix_1=g_{mT5}(Vx/2) \quad \text{equation (12)}$$

$$Ix_2=(Vx*g_{mT1})/2 \quad \text{equation (13)}$$

$$Ix=[(g_{mT5}/2)+(g_{mT1}/2)]*Vx \quad \text{equation (14)}$$

$$Z_1'=Vx/Ix=2/(g_{mT5}+g_{mT1}) \quad \text{equation (15)}$$

For a given load, the addition of transistor T5 provides a greater overall bandwidth and drives very large transistors at high currents.

Various other modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. An apparatus including a current source circuit comprising:

a first current mirror circuit configured to receive and conduct a first input current and in accordance therewith conduct a first output current which is proportional to said first input current;

a second current mirror circuit, coupled to said first current mirror circuit, configured to receive and conduct a second input current and in accordance therewith conduct a second output current which is proportional to said second input current, wherein said second input current includes a sum of said first input current and said first output current; and a current shunting circuit, coupled to said first and second current mirror circuits, wherein:

said current source circuit further comprises an input node configured to receive a source current and conduct therefrom said first input current and a shunt current;

said first current mirror circuit is coupled to said input node and is configured to provide a bias signal; and said current shunting circuit is coupled to said input node and is configured to receive said bias signal and in accordance therewith receive and conduct said shunt current.

2. The apparatus of claim 1 wherein said current shunting circuit comprises a transistor which includes:

an input terminal configured to receive said bias signal; and an output terminal configured to conduct said shunt current.

3. A method of proportionally mirroring a current, comprising the steps of:

receiving and conducting a first input current and in accordance therewith conducting a first output current which is proportional to said first input current;

receiving and conducting a second input current and in accordance therewith conducting a second output current which is proportional to said second input current, wherein said second input current includes a sum of said first input current and said first output current;

receiving a source current with an input node and conducting therefrom said first input current and a shunt current;

coupling to said input node generating a bias signal; and receiving said bias signal and in accordance therewith receiving and conducting said shunt current.

4. The method of claim 3, wherein said step of receiving said bias signal and in accordance therewith receiving and conducting said shunt current comprises:

receiving said bias signal with a transistor input terminal; and conducting said shunt current with a transistor output terminal.

5. A stacked current mirror circuit comprising:

a first transistor including a first source, a first gate and a first drain, the first drain being coupled to the first gate and a first node and configured to conduct an input current;

a second transistor, including a second source, a second gate and a second drain, the second gate being coupled to the first gate, the first source and the second source being coupled to a second node;

a third transistor including a third source, a third gate and a third drain, the third drain being coupled to the second node and the third gate;

a fourth transistor including a fourth source, a fourth gate and a fourth drain, the fourth source and the third source being coupled to a third node, the fourth gate and being coupled to the third gate, and the fourth drain being configured to conduct an output current; and a fifth transistor including a fifth source, a fifth gate, and a fifth drain, the fifth drain being coupled to the first node, the fifth gate being coupled to the second node and the fifth source being coupled to the third node.

* * * * *